United States Patent [19]

Erwin

[11] Patent Number: 4,796,527

[45] Date of Patent: Jan. 10, 1989

[54] VALUE PRINTING DIE PROTECTION MECHANISM IN A POSTAGE METER MACHINE

[75] Inventor: Timothy R. Erwin, Trumbull, Conn.

[73] Assignee: Pitney Bowes Inc., Stamford, Conn.

[21] Appl. No.: 523,507

[22] Filed: Aug. 15, 1983

[51] Int. Cl.[4] ..... B41L 39/04

[52] U.S. Cl. ..... 101/70; 101/287; 101/71

[58] Field of Search ..... 101/91, 287

[56] References Cited

U.S. PATENT DOCUMENTS

| | | | |
|---|---|---|---|
| 2,207,144 | 7/1940 | Cooper | 101/287 |
| 2,568,624 | 9/1951 | Hanson et al. | 101/91 |
| 2,829,591 | 4/1958 | Rouan | 101/91 |
| 2,833,210 | 5/1958 | Muller | 101/91 |
| 2,842,052 | 7/1958 | Coonradt | 101/287 |
| 3,173,359 | 3/1965 | Turner | 101/287 X |

*Primary Examiner*—Clyde I. Coughenour

*Attorney, Agent, or Firm*—Peter Vrahotes; Melvin J. Scolnick; David E. Pitchenik

[57] ABSTRACT

A die protection mechanism that prevents the taking of fraudulent, non-metered impressions from the value printing die surface of a postage meter machine. A linkage assembly is pivotally supported adjacent the print wheels of the postage meter machine such that a projecting portion will extend beyond the diameter of the print wheels when the postage meter machine is inoperative, but the linkage assembly will be pivoted during operation for the purpose of allowing the printing of postage on a mail piece. The mechanism is particularly useful in a postage meter having a reciprocating platen.

6 Claims, 1 Drawing Sheet

VALUE PRINTING DIE PROTECTION MECHANISM IN A POSTAGE METER MACHINE

BACKGROUND OF THE INVENTION

In the field of value printing, as for example in postage meter machines, a constant vigil is maintained to assure that the taking of fraudulent impressions from the value printing die surface of a printing member is prevented. In a reciprocating platen type of postage meter machine, this is of a particular concern since the print head of such machines is not rotated out of exposure as occurs with a rotatary type postage meter machine. One scheme for preventing the taking of fraudulent impressions is disclosed in U.S. Pat. No. 2,350,853 wherein a manually operable postage meter machine of the reciprocating type is disclosed. A rocker member with a plunger portion is utilized to prevent fraudulent impression taking. The plunger portion extends within a printing die block and is normally located beyond the perimeter of the printing dies. Although such a device functions quite well in a mechanical postage meter machine, it obviously would be impractical to adapt it for present day postage meter machines, because of the compactness and generally automatic functioning of the latter. The problem with preventing fraudulent impression taking involves exposure of the print head. The print head may be "wiped" when exposed i.e., an envelope or tape may be pressed against the print head to obtain unauthorized postage. In considering schemes for preventing such fraudulent taking of postage, problems arise with postage meter mailing machines because the print head must be exposed during a period of operation and a wrongdoer may stop operation at this particular period and obtain fraudulent impressions if no safeguards are taken.

SUMMARY OF THE INVENTION

A mechanism has been devised wherein a security feature is provided for a postage meter machine of the reciprocating platen type. In such a postage meter machine, a platen is pivotally mounted in a slot so as to be driven towards a print head upon a mail piece being inserted into the slot. In the preferred embodiment of this invention, a linkage assembly is pivotally located adjacent the print wheels of the print head. The linkage assembly has a portion that extends beyond the location of the printing dies when the postage meter machine is at rest so that there is no possibility of the print dies being wiped to obtain fraudulent impressions.

Upon a mail piece, such as an envelope, being placed into contact with a print switch located within the slot, the platen will be driven toward the selected print dies of the print head and the linkage assembly will be pivoted out of the slot so that an authorized impression may be made upon the mail piece. Subsequent to the printing of postage, the linkage assembly will be rotated in the opposite direction so that the print head will no longer be exposed, thereby securing the print head once more from unauthorized impression taking.

DETAILED DESCRIPTION OF THE PREFERRED EMBODIMENT

Figure 1:
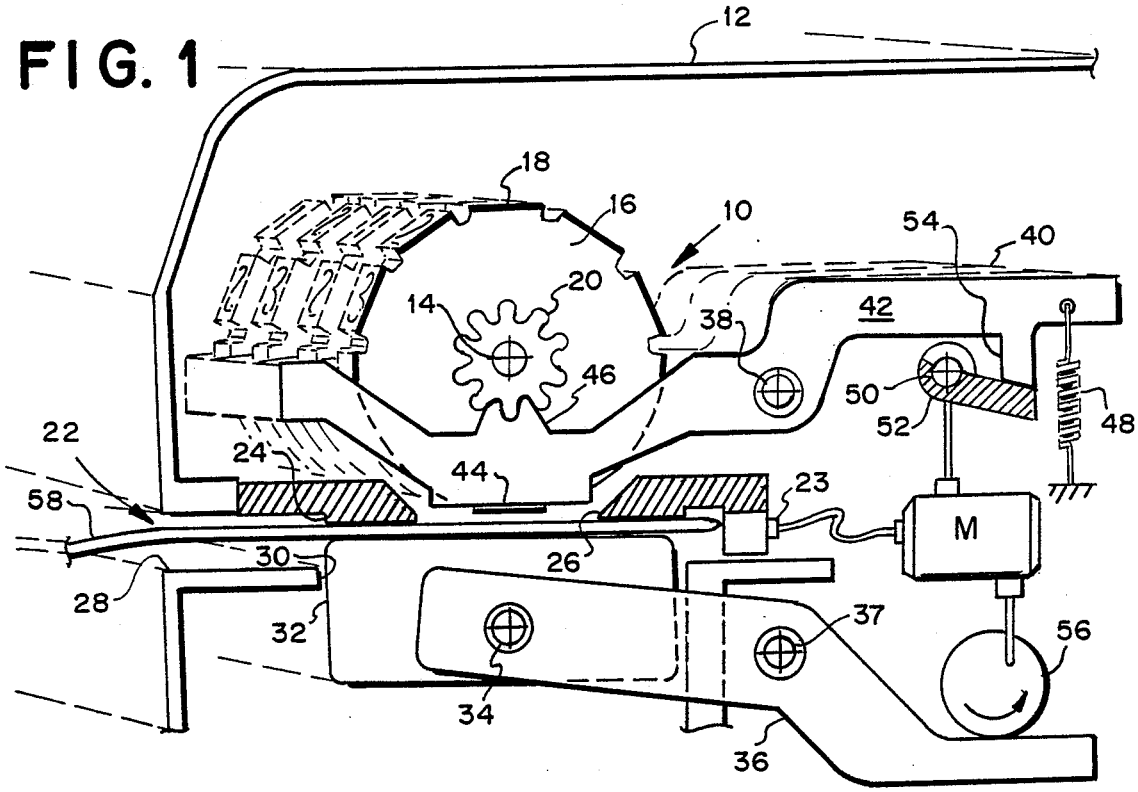
FIG. 1 is a cross sectional, partially schematic view of a postage meter machine in which the instant invention is utilized.

Referring now to the drawing, a print station of a postage meter machine is generally shown at 10 and is located within the housing 12 of the machine. A shaft 14 is mounted within the housing 12 and rotatably supports a plurality of print wheels 16. The normal number of print wheels is four although it will be appreciated the number may vary. Each of the print wheels 16 has a plurality of print dies 18 located about the perimeter thereof each print die representing one numeral from 0–9, respectively. A gear 20 is connected to each of the print wheels 16 so as to allow the selective rotation of the print wheels for printing selected postage as is well known in the art.

A portion of the postage meter machine housing 12 forms a slot 22 that has a switch 23 therein. Located at the upper part of the slot 22 is an indicia plate 24 that has an opening 26 therein through which opening the selected print dies 18 are located. On the other lower part of the slot 22 is a deck 28 that has an opening 30 therein. Received within the opening 30 is a platen 32 that is mounted for reciprocal movement. This movement is occasioned by pins 34 (only one being shown) mounted on opposite ends of the platen 32 which pins are received within pivot arms 36. The pivot arms 36 are mounted on a shaft 37 for rotation therewith, the shaft being rotatably mounted in the housing 12.

A shaft 38 is supported within the housing 12 and mounts a bracket or linkage assembly 40 for pivotal movement thereabout. The linkage assembly 40 has a plurality of links 42 each link being associated with a print wheel 16. Each of the links 42 has a dependent portion 44 that is received within the opening 26 of the indicia plate 24. Opposite the depending portion 44 is a rack 46 on each of the links 42 that are operative to mesh with the gear 20 of its associated print wheel 16. A tension spring 48 is connected at one of its ends to the linkage assembly 40 and its other end is mounted on the housing 12. A shaft 50 is rotatably supported within the housing 12 and has a pivot 52 secured thereto for rotation therewith. A finger 54 extends from the rectifier bracket 40 and is engaged by the pivot 52. A motor M is located within the housing 12 to provide drive to the linkage assembly 40 and to the pivot arms 36 through a cam 56.

Figure 2:
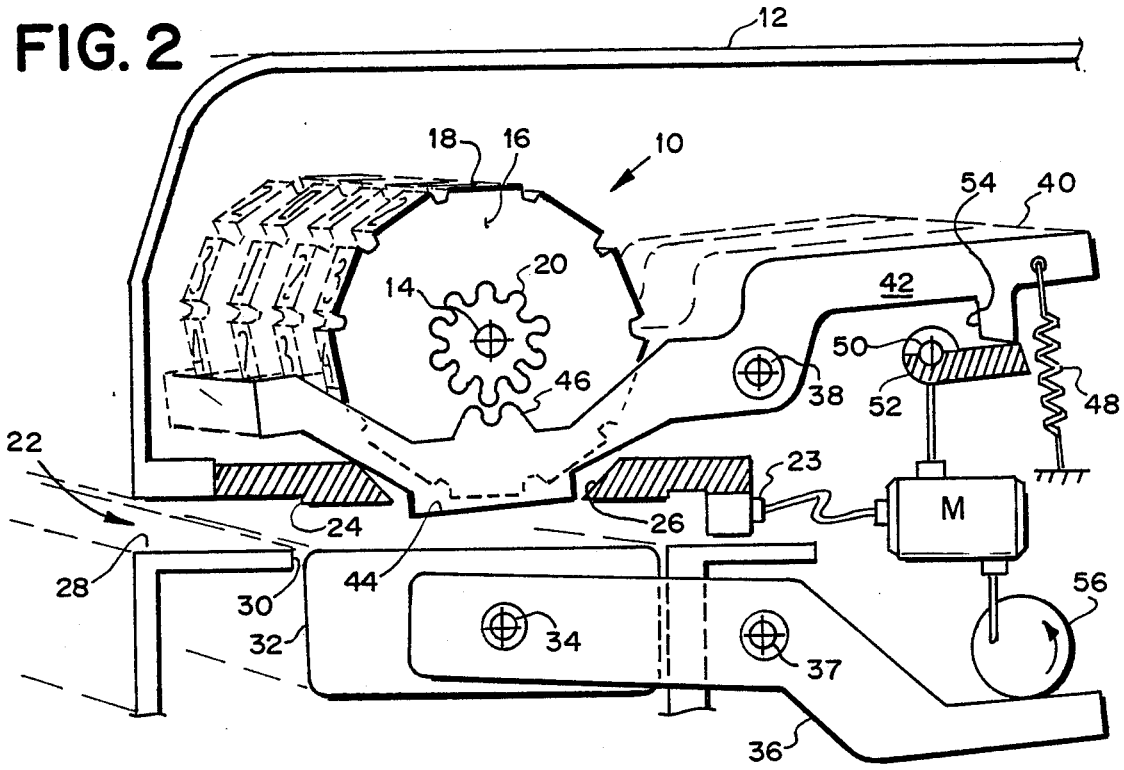
FIG. 2 is the same view as shown in FIG. 1 with the postage meter machine in a different stage of operation.

As is shown in FIG. 2, when the print station 10 is not in the act of printing, the depending portions 44 of the linkage assembly 40 will be received within the opening 26 and extend below the level of the indicia plate 24 so that the depending portions are located beyond the print dies 18 located on the perimeter of the print wheels 16 as well as beyond the surface of the indicia plate 24, thereby preventing the print wheels and indicia plate from being "wiped". The depending portions 44 act as a physical barrier preventing the taking of unauthorized impressions. During the printing operation, which is initiated by a mail piece 58, such as an envelope, engaging the switch 23, the shaft 50 is rotated in a clockwise direction, as seen in FIG. 1, so that the pivot 52 is moved away from the finger 54. With this event, the tension spring 48 pivots the linkage assembly 40 about the shaft 38 to push the racks 42 into engagement with the gears 20 of the print wheels 16. In this position, the depending portions 44 are lifted away from the platen 32 so that they no longer extend beyond the print dies 18 and the racks 46 engage the gear 20 teeth to rectify and lock the print wheels 16. As this occurs, the pivot arms 36 will be pivoted by the cam 56 to lift the platen 32 into the printing engagement with the indicia plate 24 and the print wheels 16 to make an impression upon the mail piece that had been inserted into the slot 22.

After the printing of postage has been completed, the shaft 50 will be rotated in the counterclockwise direction as seen in FIG. 2 and the pivot 52 will engage the finger 54 to overcome the spring 48. With this occurring, the linkage assembly 40 will pivot in the counterclockwise direction about the shaft 38 so that the depending portions 44 are driven towards the platen 32 and into the space 26 to a location beyond the perimeter of the print wheels 16, including the print dies 18, and beyond the surface of the indicia plate 24. In this blocking position, one would be prevented from placing an object into complete contact with the print wheels 16 and the indicia plate 24. As a consequence, only a partial impression would be obtained which could not serve as postage.

As will be readily appreciated, what has been provided is a mechanism which not only prevents the unauthorized taking of impressions but also acts to secure the print wheels for proper registration during the printing operation through the meshing of the racks 46 with the gear 20 teeth.

What is claimed is:

1. A mechanism for preventing the taking of fraudulent impressions from the print wheels of a postage meter machine that has settable print wheels, a reciprocating platen operative to be moved into contact with the print wheels, means for reciprocally driving the platen into and out of printing contact with the print wheels, a print switch for sensing upon the platen the presence of a mail piece to be imprinted and to activate a driving means to drive the platen into and out of contact with the print wheels, comprising: linkage means pivotally supported within the machine adjacent the print wheels, said linkage means having a portion that extends intermediate the print wheels and the platen when said linkage means is in a first position, means for moving said linkage means upon the print switch being enabled to a second position wherein said portion is moved away from a position between the print wheels and the platen and means for returning the linkage means to said first position upon the platen being driven into and out of contact with the print wheels by the driving means.

2. A mechanism for preventing fraudulent impressions being obtained from the print wheels of a reciprocating type of postage meter machine that has print wheels settable through gears integral therewith, a reciprocating platen operative to be moved into contact with the print wheels, drive means for reciprocally driving the platen into and out of contact with the print wheels, a print switch for sensing the presence of a mail piece to be imprinted upon the platen and activating the drive means to affect a print cycle by driving the platen into contact with the print wheels upon actuation of the print switch, comprising: a bracket pivotally supported within the machine and having a plurality of links each of which is adjacent a print wheel, said bracket having an extending portion, said extending portion being located intermediate the print wheels and the platen when in a first position, the drive means being operative to move said bracket to a second position such that said extending portion is moved away from a position between the print wheels and the platen upon the power switch being enabled, said bracket engaging the gears of the print wheels to secure the print wheels, and a means for returning the rectifier bracket to said first position upon the platen being driven out of print contact with the print wheels whereby said bracket will become disengaged from the gears of the print wheels.

3. A method of preventing the taking of fraudulent impressions from the print wheels of a postage meter machine that has settable print wheels, a reciprocating platen operative to be moved into printing contact with the print wheels, and a print switch for sensing the presence of a mail piece upon the platen, the steps comprising: placing a linkage assembly within the machine at a first position such that a portion of the linkage assembly extends intermediate the print wheels and the platen, placing a mail piece into contact with the print switch, moving the linkage assembly to a second position such that the linkage assembly portion is moved away from a position between the print wheels and the platen, driving the platen into printing contact with the print wheels, driving the platen away from the print wheels, and returning the linkage assembly to its first position as the platen is driven away from the print wheels.

4. A method of preventing the taking of fraudulent impressions from the print wheels of a postage meter machine that has settable print wheels having gears connected thereto, a reciprocating platen operative to be moved into printing contact with the print wheels and, a print switch for activating a print cycle, the steps comprising: placing a linkage assembly within the postage meter machine at a first position such that a first portion of the bracket extends intermediate the print wheels and the platen, activating the print switch to initiate a print cycle, moving the linkage assembly to a second position such that its first portion is moved away from a position between the print wheels and the platen and a second portion of the linkage assembly contacts the print wheel gears to lock the print wheels, reciprocally driving the platen into printing contact with the print wheels, driving the platen away from the print wheels, and returning the linkage assembly to its first position as the platen is driven away from the print wheels.

5. A method of preventing the taking of fraudulent impressions from a postage meter machine that has settable print wheels, a reciprocating platen operative to be moved into printing contact with the print wheels and a print switch for initiating a print cycle, the steps comprising: placing a blocking member in a position intermediate the print wheels and the platen, actuating the print switch, removing the blocking member from the intermediate position, locking the print wheels, driving the platen into printing contact with the print wheels, driving the platen away from the print wheels, and returning the blocking member to the intermediate position as the platen is driven away from the print wheels.

6. A method of preventing the taking of fraudulent impressions from a postage meter machine that has settable print wheels, a reciprocating platen operative to be moved into printing contact with the print wheels and a print switch for initiating a print cycle, the steps comprising: placing a blocking member in a position intermediate the print wheels and the platen, actuating the print switch, removing the barrier from the intermediate position, locking the print wheels, driving the platen into printing contact with the print wheels, driving the platen away from the print wheels, returning the blocking member to the intermediate position and unlocking the print wheels as the platen is driven away from the print wheels.

* * * * *